US010167830B2

(12) United States Patent
Serra et al.

(10) Patent No.: US 10,167,830 B2
(45) Date of Patent: Jan. 1, 2019

(54) FUEL RAIL ASSEMBLY FOR AN INTERNAL COMBUSTION ENGINE

(71) Applicant: Continental Automotive GmbH, Hannover (DE)

(72) Inventors: Giandomenico Serra, Ghezzano-S.Giuliano Terme (IT); Gisella Di Domizio, San Giuliano Terme (IT); Andrea Puccini, San Miniato (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 137 days.

(21) Appl. No.: 15/218,276

(22) Filed: Jul. 25, 2016

(65) Prior Publication Data

US 2017/0022951 A1 Jan. 26, 2017

(30) Foreign Application Priority Data

Jul. 23, 2015 (EP) ..... 15178025

(51) Int. Cl.
*F02M 55/00* (2006.01)
*F02M 61/14* (2006.01)
*F02M 55/02* (2006.01)

(52) U.S. Cl.
CPC ..... *F02M 55/005* (2013.01); *F02M 55/02* (2013.01); *F02M 55/025* (2013.01);
(Continued)

(58) Field of Classification Search
CPC .... F02M 55/02; F02M 55/005; F02M 55/025; F02M 61/14; F02M 2200/856; F02M 2200/857; F02M 2200/8015
(Continued)

(56) References Cited

U.S. PATENT DOCUMENTS 9,103,308 B2 8/2015 Serra et al.
2003/0084881 A1 5/2003 Mori ..... 123/456
(Continued)

FOREIGN PATENT DOCUMENTS

CN 201284714 Y 8/2009 ..... F02M 61/14
CN 202194762 U 4/2012 ..... F02M 61/14
(Continued)

OTHER PUBLICATIONS

Korean Office Action, Application No. 2017064562029, 17 pages, dated Sep. 14, 2017.
(Continued)

*Primary Examiner* — Hieu T Vo
*Assistant Examiner* — Arnold Castro
(74) *Attorney, Agent, or Firm* — Slayden Grubert Beard PLLC

(57) ABSTRACT

The present disclosure relates to a fuel rail assembly for an internal combustion engine. In some embodiments, a fuel rail assembly for an internal combustion engine may include an elongated tubular fuel rail and a plurality of fuel delivery lines branching off from the fuel rail for hydraulically coupling the fuel rail to fuel injectors operable to inject fuel into the combustion engine. Also, an injector cup for receiving a fuel inlet portion of a respective one of the fuel injectors, a pipe arranged between the fuel rail and the injector cup for hydraulically coupling the injector cup to the fuel rail, and a fixation bracket configured for positionally fixing the fuel delivery line with respect to the engine. The injector cup, the pipe, and the fixation bracket are individual parts. A rigid connection is established between the fixation bracket and a portion of the pipe, said portion spaced apart from each of the fuel rail and from the injector cup. The fixation bracket is a one-pieced part which adjoins the pipe and is spaced apart from the injector cup and the fuel rail.

10 Claims, 4 Drawing Sheets

(52) U.S. Cl.
CPC ..... *F02M 61/14* (2013.01); *F02M 2200/8015* (2013.01); *F02M 2200/8084* (2013.01); *F02M 2200/856* (2013.01); *F02M 2200/857* (2013.01)

(58) Field of Classification Search
USPC ..... 123/456, 469
See application file for complete search history.

(56) References Cited

U.S. PATENT DOCUMENTS

| | | | | |
|---|---|---|---|---|
| 2004/0118382 | A1* | 6/2004 | Usui | F02M 55/004 123/456 |
| 2006/0137659 | A1 | 6/2006 | Zdroik et al. | 123/470 |
| 2013/0068198 | A1* | 3/2013 | Maier | F02M 69/50 123/456 |
| 2013/0104852 | A1* | 5/2013 | Kannan | F02M 61/168 123/456 |
| 2015/0075496 | A1* | 3/2015 | Pasquali | F02M 61/14 123/469 |
| 2015/0136084 | A1 | 5/2015 | Maier et al. | 123/452 |
| 2015/0198128 | A1* | 7/2015 | Mechi | F02M 55/025 123/456 |

FOREIGN PATENT DOCUMENTS

| | | | | |
|---|---|---|---|---|
| CN | 102713240 | A | 10/2012 | F02M 55/02 |
| CN | 203499881 | U | 3/2014 | F02M 55/02 |
| DE | 102008035489 | A1 | 2/2010 | F02M 55/02 |
| DE | 102009004773 | A1 | 7/2010 | F02M 55/02 |
| DE | 102011086209 | A1 | 5/2013 | F02M 41/00 |
| EP | 2607678 | A1 | 6/2013 | F02M 55/00 |
| EP | 2690281 | A1 | 1/2014 | F02M 55/02 |
| EP | 2851552 | A1 | 3/2015 | F02M 61/14 |
| JP | 2007040248 | A | 2/2007 | F02M 55/02 |
| JP | 2008163780 | A | 7/2008 | F02M 55/02 |
| WO | 2016/079004 | A1 | 5/1916 | F02M 55/00 |
| WO | 2014/016231 | A1 | 1/2014 | F02M 55/02 |

OTHER PUBLICATIONS

Extended European Search Report, Application No. 15178025.1, 7 pages, dated Dec. 23, 2015.
Chinese Office Action, Application No. 201610581431.0, 19 pages, dated May 4, 2018.

* cited by examiner

FUEL RAIL ASSEMBLY FOR AN INTERNAL COMBUSTION ENGINE

CROSS-REFERENCE TO RELATED APPLICATIONS

This application claims priority to EP Application No. 15178025.1 filed Jul. 23, 2015, the contents of which are hereby incorporated by reference in their entirety.

TECHNICAL FIELD

The present disclosure relates to a fuel rail assembly for an internal combustion engine.

BACKGROUND

Fuel rails, in particular for gasoline direct injection engines, are usually designed according to the engine packaging of the specific internal combustion engine. Usually, the design of the fuel rail is specific to a particular engine and unusable for other engines.

SUMMARY

The present disclosure describes a fuel rail which is easily configurable during production for use with engines of different shapes and/or which is particularly cost effective.

In some embodiments, a fuel rail assembly (3) for an internal combustion engine (1) comprises an elongated tubular fuel rail (31) and a plurality of fuel delivery lines (11) branching off from the fuel rail (31) for hydraulically coupling the fuel rail (31) to fuel injectors (7) which are operable to inject fuel into the combustion engine (1). Each fuel delivery line (11) has: an injector cup (47) for receiving a fuel inlet portion of a respective one of the fuel injectors (7); a pipe (41) being arranged between the fuel rail (31) and the injector cup (47) for hydraulically coupling the injector cup (47) to the fuel rail (31); and a fixation bracket (49) which is configured for positionally fixing the fuel delivery line (11) with respect to the engine (1). The injector cup (47), the pipe (41), and the fixation bracket (49) are individual parts. A rigid connection is established between the fixation bracket (49) and a portion of the pipe (41), said portion being spaced apart from each of the fuel rail (31) and from the injector cup (47). The fixation bracket (49) is a one-pieced part which adjoins the pipe (41) and is spaced apart from the injector cup (47) and the fuel rail (31).

In some embodiments, the fixation bracket (49) comprises a receptacle bore (490) which is configured for receiving a fixation element (9) that is operable to fix the fixation bracket (49) rigidly to the internal combustion engine. The receptacle bore (490) has an elongated cross-sectional shape to enable positioning the fixation element (9) at different distances from the pipe (41) in the receptacle bore (490).

In some embodiments, the rigid connection is established between a connection surface (496) of the fixation bracket (49) and said portion of the pipe (41), the connection surface (496) being in the general shape of a section of a cylinder shell to establish a full-area contact between the connection surface (496) and the pipe (41).

In some embodiments, the rigid connection is established between a connection surface (496) of the fixation bracket (49) and said portion of the pipe (41), the connection surface (496) being represented by a through-hole through which the pipe (41) extends.

In some embodiments, an external surface of the fixation bracket (49) has one or more rounded edges adjacent to the pipe (41).

In some embodiments, the receptacle bore (490) perforates the fixation bracket (49) in a mounting direction (M), a central axis (C) of the opening (491) being inclined with respect to a central axis (R) of said portion of the pipe (41).

In some embodiments, the injector cup (47) has an indexing element (471) for determining an angular position of the respective one of the fuel injectors (7) relative to the injector cup (47) and the individual parts of the fuel delivery line (11) are configured and connected in such fashion that an angular position of the fixation bracket (49) relative to the indexing element (471) and/or relative to the elongation direction (E) of the fuel rail (31) is adjustable during assembly of the fuel rail assembly (3).

In some embodiments, the rigid connection is a brazed or welded connection.

In some embodiments, the pipe (41) is connected to the injector cup (47) by means of a brazed or welded connection.

In some embodiments, each fuel delivery line comprises an outlet port tube (39) which is attached to an outer surface of the fuel rail (31) by means of a brazed or welded connection.

Some embodiments include one or both of a sensor port tube (37) branching off from the fuel rail (31), a fixation lug (13) for fixing the fuel rail (31) to the internal combustion engine (1). The sensor port tube (37) and/or the fixation lug (13) may be fixed to an outer surface of the fuel rail (31) by a respective brazed or welded connection, and/or the sensor port tube (37) and/or the fixation lug (13) are shaped and connected to the fuel rail (31) in such fashion that a position of the sensor port tube (37) and/or the fixation lug (13), respectively, on the outer surface is adjustable during assembly of the fuel rail assembly (3).

Some embodiments may include at least one of the following elements: an inlet fitting (33) received in the fuel rail (31), and an end plug (35) plugged into the fuel rail (31), wherein the inlet fitting (33) and/or the end plug (35) is/are fixed to the fuel rail (31) by a respective brazed or welded connection.

BRIEF DESCRIPTION OF THE DRAWINGS

Further advantages, advantageous embodiments, and developments of the fuel rail assembly and of the method will become apparent from the exemplary embodiments which are described below in association with schematic figures.

In the figures.

DETAILED DESCRIPTION

Figure 1:
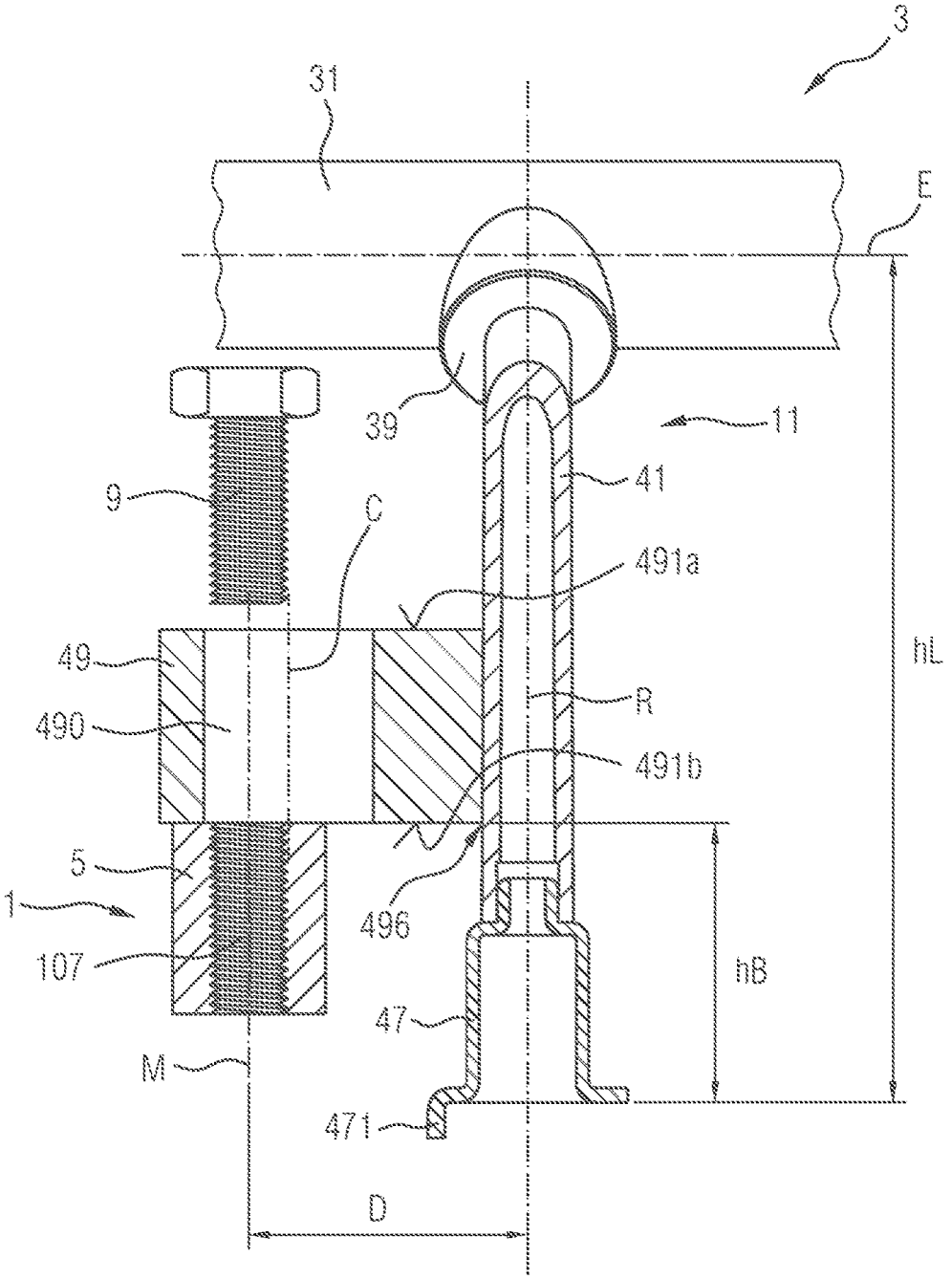
FIG. 1 shows a partially cut side view of a fuel rail assembly according to a first embodiment.

The fuel rail assembly comprises an elongated tubular fuel rail. The elongated tubular fuel rail is in particular a tubular fuel reservoir. In some embodiments, it is a straight tube. The fuel rail may be made of a metal or an alloy.

Generally, fuel is supplied under high pressure into the fuel rail, in particular by a fuel pump, and stored in the fuel rail for being dispensed into the internal combustion engine by a plurality of fuel injectors. The fuel injectors are operable to inject the fuel directly into respective combustion chambers of the combustion engine.

The fuel rail assembly has a plurality of fuel delivery lines for hydraulically coupling the fuel rail to the fuel injectors which are operable to inject fuel into combustion engine. Each of the fuel delivery lines branches off from the fuel rail. Each of the fuel delivery lines is in particular assigned to one and only one of the injectors.

In the following, only one of the fuel delivery lines is described in detail. However, the fuel delivery lines may be of identical type. The fuel delivery lines may be arranged subsequently to one another along an elongation direction of the tubular fuel rail.

Each fuel delivery line has an injector cup for receiving a fuel inlet portion of a respective one of the fuel injectors. The injector cup comprises a recess into which the fuel inlet portion is shifted for hydraulically coupling the injector cup and the fuel inlet portion.

Each fuel delivery line further has a pipe which is arranged between the fuel rail and the injector cup for hydraulically coupling the injector cup to the fuel rail. In particular, the pipe is operable to guide the fuel from the fuel rail to the injector cup. A downstream end of the pipe may be hydraulically and mechanically connected to the injector cup. An upstream end of the pipe may be hydraulically and mechanically connected to the fuel rail, either directly or via an outlet port on the fuel rail. In the present context, the expressions "upstream" and "downstream" refer to the direction of fuel flow from the fuel rail to the fuel injector.

Each fuel delivery line further comprises a fixation bracket which is configured for positionally fixing the fuel delivery line which respect to the combustion engine. In this way, the fixation bracket also contributes to positionally fixing the fuel rail assembly with respect to the combustion engine.

The injector cup, the pipe, and the fixation bracket are individual parts. In other words, the injector cup, the pipe and the fixation bracket are separately manufactured pieces which are fixed together only during assembly of the fuel rail assembly.

A rigid connection is established between the fixation bracket and a portion of the pipe. This portion of the pipe is also referred to as a "fixation portion" of the pipe in the following.

The fixation portion of the pipe may be spaced apart from the fuel rail and also from the fuel injector cup. Such a position of the rigid connection is particularly advantageous with regard to the mechanical stability of the fuel delivery line.

The fixation bracket is a one-pieced part which adjoins the pipe and is spaced apart from the injector cup and the fuel rail. In particular, it is spaced apart from all other parts of the fuel rail assembly which are positionally fixed relative to the fuel rail and/or the injector cup. The fixation bracket may be shaped and positioned such that, absent the rigid connection, the fixation bracket is axially and rotationally displaceable relative to a longitudinal axis of the pipe for adjusting the position of the fixation bracket with respect to the pipe during production of the fuel rail assembly. For example, the fixation bracket is made from a metal or an alloy. In particular, it is a steel part. In some embodiments, the fixation bracket is a cold-formed part, a machined part or a cast part.

In this way, the fuel rail assembly is adjustable for different engine configurations by adjusting the position of the fixation bracket or by exchanging only the fixation bracket while retaining the design of the remaining parts. Manufacturing of the one-pieced fixation bracket may be particularly simple and/or precise. In this way, production of the fuel rail assembly may be particularly cost effective.

According to one embodiment, the fixation bracket comprises a receptacle bore which is configured for receiving a fixation element that is operable to fix the fixation bracket rigidly to the internal combustion engine. In particular it is configured to fix the fixation bracket rigidly to a cylinder head of the combustion engine. The fixation element is, for example, a screw or a bolt.

The receptacle bore has in particular an elongated cross-sectional shape to enable positioning the fixation element at different distances from the pipe. The fixation element may have a main elongation direction—usually its mounting direction. The shapes and sizes of the receptacle bore and the fixation element may be adapted to one another in such fashion that, before the fixation element engages with the internal combustion engine for fixing the fixation bracket to the internal combustion engine, the fixation element is movable perpendicular to the main elongation direction within the receptacle bore towards and away from the pipe. In this way, the same fixation bracket is usable for differently shaped engines and/or is particularly insensitive to mounting tolerances.

In some embodiments, the receptacle bore has a central axis and perforates the fixation bracket in direction of its central axis. The central axis of the receptacle bore is inclined with respect to a central axis of the fixation portion of the pipe. Such a configuration is easily and precisely achievable with the one-pieced fixation bracket. In particular simple and precise adjustment of both central axes is achievable by machining one piece.

In some embodiments, the rigid connection is established between a connection surface of the fixation bracket and the fixation portion of the pipe. The connection surface is in the general shape of a section of a cylinder shell to establish a full-area contact between the connection surface and the pipe. Expediently, at least the fixation portion of the pipe has a cylindrical outer surface in this case. In this way, a particularly reliable rigid connection is achievable between the pipe and the fixation bracket. In some embodiments, the connection surface of the fixation bracket has a longitudinal axis which is parallel and in particular coaxial with respect to the central axis of the fixation portion of the pipe.

In some embodiments, the connection surface of the fixation bracket is represented by a through-hole through which the pipe extends. In this way, a press-fit connection can be established between the pipe and the fixation bracket, for example for retaining the position of the fixation bracket relative to the pipe while the rigid connection is established.

In some embodiments, the injector cup has an indexing element for determining an angular position of the respective fuel injector relative to the injector cup. The individual parts of the fuel delivery line may be configured and connected in such fashion that an angular position of the fixation bracket relative to the indexing element and/or relative to the elongation direction of the fuel rail is adjustable during assembly of the fuel rail assembly. For example, the injector cup is rotatable relative to the pipe during manufacturing the fuel rail assembly and a further rigid connection between the injector cup and the pipe is only established during manufacturing of the fuel rail assembly after setting a predetermined angular position of the indexing element. The angular position may be predetermined according to the configuration of the respective engine for which the fuel rail assembly is manufactured. Analogously, the fixation bracket may be rotatable relative to the pipe before establishing the rigid connection between the fixation bracket and the pipe during manufacturing the fuel rail assembly.

In some embodiments, the rigid connection between the fixation bracket and the pipe and/or the further rigid connection between the pipe and the injector cup is/are brazed and/or welded connections. For example, the respective connection is established by a welded pre-connection and a fluid-tight brazed connection. The welded pre-connection may be a spot-welded connection. The welded pre-connection may be replaced or complemented by a press-fit connection in case of a through-hole representing the connection surface of the fixation bracket. By means of such connections, the angular positions are particularly easily adjustable during assembly of the fuel rail assembly.

In some embodiments, an external surface of the fixation bracket has one or more rounded edges adjacent to the pipe. The rounded edge(s) is/are in particular positioned at the interface between the fixation bracket and the fixation portion of the pipe. Such rounded edges are advantageous for achieving a particularly reliable brazed connection, for example.

In some embodiments, each fuel delivery line comprises an outlet port tube. The outlet port tube is in particular a further individual part, which may be manufactured separately from the injector cup, the pipe, and the fixation bracket. The outlet port tube may be attached to an outer surface of the fuel rail. In particular, it is shaped in such fashion, that its position on the outer surface is adjustable during assembly of the fuel rail assembly. For example, during manufacturing of the fuel rail assembly, the fuel rail may be provided with bores for dispensing fuel into the fuel delivery lines.

The position of the bores is predetermined according to the engine configuration for which the fuel rail assembly is produced and may vary from fuel rail to fuel rail. The outlet port tubes can be positioned laterally surrounding a respective bore of the fuel rail, independent on the position of the bore in the fuel rail. The outlet port tubes may be attached to the outer surfaces of the fuel rail by means of a brazed and/or welded connection, in particular as detailed above.

In some embodiments, the fuel rail has a sensor port tube which branches off from the fuel rail. In some embodiments, the fuel rail assembly has a fixation lug for fixing the fuel rail to the internal combustion engine. The sensor port tube and/or the fixation lug is/are fixed to the outer surface of the fuel rail. The fixation may be established by a respective brazed and/or welded connection, in particular as detailed above. In some embodiments, the sensor port tube and/or the fixation lug is/are shaped and connected with the fuel rail in such fashion that a position of the sensor port tube and the fixation lug, respectively, on the outer surface is adjustable during assembly of the fuel rail assembly. For example, the outlet port tube, the sensor port tube and/or the fixation lug have respective connection surfaces which are congruent to a portion of the outer surface of the fuel rail.

In some embodiments, the fuel rail assembly comprises an inlet fitting which is received in the fuel rail and/or an end plug which is plugged into the fuel rail. The inlet fitting and the end plug may be positioned at opposite axial ends of the fuel rail. Alternatively, the fuel rail assembly can have end plugs at both axial ends of the fuel rail while the inlet fitting branches off from the outer, circumferential surface of the fuel rail. The end plug(s) can be replaced by a respective end cap which is shifted over the fuel rail. In some embodiments, the inlet fitting and/or the end plug(s) or end cap(s) are fixed to the outer surface of the fuel rail by a respective brazed and/or welded connection, in particular as detailed above. The inlet fitting and/or the end plug can also be fixed to the fuel rail by means of a brazed connection with an inner surface of the fuel rail, in particular in embodiments in which the inlet fitting and the end plug(s), respectively, are shifted into the fuel rail.

In some embodiments, all connections between the individual, above mentioned parts of the fuel rail assembly are brazed and/or welded connections. For example, the connections are each established by a welded pre-connection and a fluid-tight brazed connection. The welded pre-connection may be a spot-welded connection. In this way, production of the fuel rail is particularly cost effective.

That the fixation brackets "positionally fix" the fuel delivery line with respect to the engine and the fixation lug "fixes" the fuel rail to the internal combustion engine means in particular that the fuel delivery line or the fuel rail, respectively, is held in place with respect to the combustion engine by means of the fixation bracket or the fixation lug, respectively. In particular, the fixation brackets and/or the fixation lug are coupled to the combustion engine by fixing element such as screws or bolts.

In some embodiments, there are no further screw-connections between the fuel rail assembly and the combustion engine, apart from those with the fixation brackets and the fixation lug, as the case may be. This, however, is not meant to exclude the presence of other, in particular inevitable, mechanical coupling between the fuel rail and the combustion engine, e.g. through hydraulic connections such as via the inlet fitting or the fuel injectors. In some embodiments, however, no mechanical connection is made between the fuel rail assembly and the combustion engine—apart from the fixation brackets and the fixation lug, as the case may be—which is primarily provided for mechanically fixing the fuel rail assembly to the combustion engine.

In the exemplary embodiments in figures similar, identical or similarly acting elements are provided with the same reference symbols.

Figure 2:
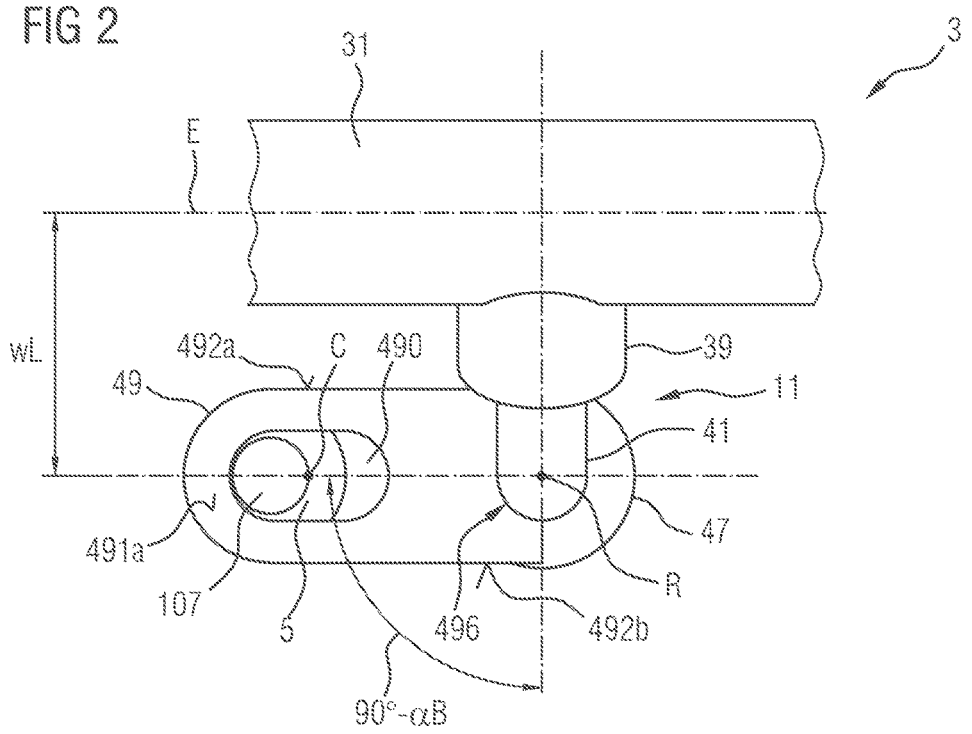
FIG. 2 shows a top view of the fuel rail assembly according to the first embodiment.
Figure 3:
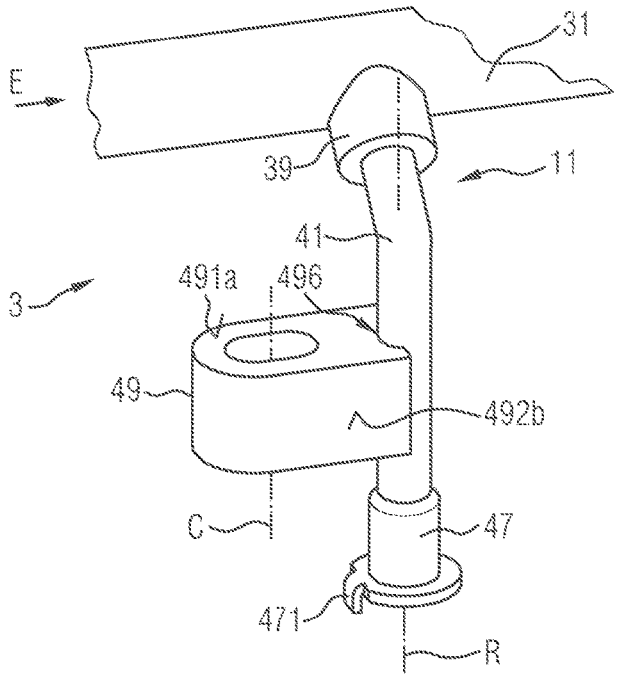
FIG. 3 shows a perspective view of the fuel rail assembly according to the first embodiment.

FIG. 1 shows a partially cut side view of fuel rail assembly 3 according to a first embodiment. FIGS. 2 and 3 show a top view and a perspective view, respectively, of the fuel rail assembly 3.

The fuel rail assembly 3 is configured to supply fuel to an internal combustion engine 1. The internal combustion engine 1 has a cylinder head 5 which comprises installation bores (not shown) for receiving fuel injectors (not shown). Only a portion of the cylinder head 5 is shown in FIG. 1, other parts of the combustion engine are omitted for better representability.

The fuel rail assembly 3 comprises in elongated tubular fuel rail 31. In some embodiments, the fuel rail 31 is metallic; in particular it is made from steel. Fuel is supplied to the fuel rail 31 through an inlet fitting (not shown) on one axial end of the fuel rail 31. The opposite axial end of the fuel rail 31 is sealed by an end plug (not shown). The fuel rail 31 may be fixed with respect to the engine one by means of a fixation lug (not shown). A sensor port tube (not shown) may branch off from the fuel rail 31.

In addition, a plurality of fuel delivery lines 11 branch off from the fuel rail 31. One of the fuel delivery lines 11 is shown in the portion of the fuel rail assembly 1 which is visible in FIGS. 1, 2 and 3. The fuel delivery lines 11 are spaced apart from one another and follow one another in an elongation direction E of the fuel rail 31. The fuel delivery lines 11 are operable to connect the fuel rail 31 hydraulically to the fuel injectors. In an expedient embodiment, the fuel injectors are also held in place by the fuel rail assembly 3.

All fuel delivery lines 11 may be of identical construction. Each fuel delivery line 11 comprises an outlet port tube 39, a pipe 41 and an injector cup 47. The outlet port tube 39, the pipe 41 and the injector cup 47 are individual, separately manufactured and separately provided parts, which are assembled during manufacturing the fuel rail assembly 3. The outlet port tube 39 is fixed to an outer surface of the fuel rail 31. It circumferentially surrounds a bore in the circumferential wall of the fuel rail 31 so that it is hydraulically connected to the fuel rail 31 and fuel can flow from the fuel rail 31 into the outlet port tube 39.

An upstream end of the pipe 41 is fixed to the outlet port tube 39 for hydraulically and mechanically coupling the pipe 41 to the outlet port tube 49. In one development, the upstream end is shifted through the outlet port tube 39 into the respective bore in the fuel rail 31. A downstream end of the pipe 41 is hydraulically and mechanically coupled to the injector cup 47. In this way, the injector cup 47 is hydraulically coupled to the fuel rail 31 by means of the pipe 41 and the outlet port tube 39. In one embodiment, the pipe 41 is a rigid metal tube and is in one development made from steel.

Each fuel delivery line 11 comprises a further individual part which is a fixation bracket 49. The fixation bracket 49 is rigidly connected to a portion of the pipe 41—also denoted as "fixation portion" in the following—between the outlet port tube 39 and the injector cup 47. The fixation bracket 49 adjoins the fixation portion of the pipe 41 and is spaced apart from the injector cup 47 and from the outlet port tube 39 and the fuel rail 31. In the present embodiment, each fixation bracket 49 is a one-pieced—in particular machined or cast—metal part.

Each fixation bracket 49 comprises a receptacle bore 490 which is configured for receiving a fixation element 9. The fuel delivery lines 11 are rigidly fixed to the cylinder head 5 by means of fixation elements 9 via the fixation brackets 49. The fixation elements 9 may be screws, as shown in FIG. 1, or a bolt, for example. The screw which represents the fixation element 9 in the present embodiment is screwed into a threaded opening 107 of the cylinder head 5 for establishing the rigid fixation. In FIG. 1, the fixation element 9 is shown before it is mounted into the receptacle bore 490 and the threaded opening 107 along a mounting direction M. It is omitted for the sake of better representability in FIGS. 2 and 3.

The fixation portion of the pipe 41 has a central axis R. The receptacle bore 490 of the fixation bracket 490 has a central axis C. In the present embodiment, the central axis C of the receptacle bore 490 extends parallel to a central axis R of the fixation portion of the pipe 41. The side view of FIG. 1 is cut along a plane which comprises these central axes C, R. The view of FIG. 2 is a top view along the central axes C, R.

The receptacle bore 490 has an elongated cross-sectional shape. In the present embodiment, its cross-sectional shape is the set union of a rectangular area and two semi-circular areas which share their respective straight edges with opposite sides of the rectangular area. The semi-circular areas are subsequently arranged in a radial direction from the central axis of the fixation portion of the pipe 41 to the central axis of the receptacle bore 490. The fixation element 9 is movable in this radial direction—perpendicular to the mounting direction M—within the receptacle bore 490 towards and away from the pipe 41 before it enters into the opening 107 of the cylinder head 5. This enables usage of the same fixation bracket 49 for different distances D between the pipe 41 and the opening 107 of the cylinder head 5. In the present embodiment, the fixing element 9 is laterally offset relative to the central axis C of the receptacle bore 490. Other cross-sectional shapes of the receptacle bore 490 are also conceivable, for example an ellipsoidal or rectangular shape.

The individual parts of the fuel rail assembly 3 are connected to one another as described above and fixed by means of rigid connections which in particular are brazed connections. It also is considerable that some or all of the connections are welded connections.

Expediently, producing the rigid connections may involve pre-connecting the individual parts by means of welded connections, in particular by spot welds, before the brazed connections are manufactured. Such connections are also referred to as "brazed connections" in the present context.

In particular, during manufacturing of the fuel rail assembly 3, the individual parts are closely fitted to one another. Subsequently, spot-welded connections are produced at the respective joined interface regions which positionally fix the parts for the subsequent manufacturing steps. In one embodiment, a filler metal or alloy is applied at the respective joined interface regions subsequently to producing the spot-welded connections.

For example in this case, the filler material may be applied in form of a paste. Alternatively, the filler metal or alloy can be applied before producing the spot-welded connections. For example in this case, the filler material may be applied in form of a self-supporting and/or dimensionally stable object, such as a ring. In one development, one of the parts comprises a recess at the interface region for accommodating the filler material object. The preassembled fuel rail assembly 3 is subsequently introduced into a furnace for melting the filler metal or filler alloy, respectively. In an expedient embodiment, copper is used as the filler material. In this way, a rigid brazed connection is in particular established between in the fixation bracket 49 and the fixation portion of the pipe 41.

The fixation bracket 49 has a connection surface 496 which is in the shape of a section of a cylinder shell and is in full area contact with the fixation portion of the pipe 41. The rigid brazed connection between the fixation bracket 49 and the pipe 41 is established between the connection surface 496 and the fixation portion of the pipe 41.

As can be seen in FIG. 1, the injector cup 47 has an upper end portion which is shifted into the downstream end of the pipe 41 for connecting the injector cup 47 and the pipe 41. The upstream end of the pipe 41 is shifted into the outlet port tube 39.

The connection surfaces of the outlet port tubes 39 which are adjoining the fuel rail 31, the connection surface of fixation lug and the connection surface of the sensor port tube each are portions of a cylinder surface which is congruent to the cylinder surface which will represents the outer surface of the fuel rail 31. In this way, the outlet port tubes 39, the fixation lug and the sensor port tube can be positioned at any desirable place on the outer surface of the fuel rail 31. Therefore, the position of the first outlet port tube 39 with respect to an axial end of the fuel rail 31 can be selected during manufacturing the fuel rail assembly 3, the position of the fixation lug 13 along the elongation direction E of the fuel rail 31 can be selected during manufacturing the fuel rail assembly 3 as well as the position of the sensor port tube 37 along the elongation direction E.

In the present embodiment, each injector cup 47 has an indexing element 471 (cf. FIGS. 1 and 3). In the present case, the indexing element 471 is an indexing tab which axially protrudes beyond the rest of the injector cup 47 towards the fuel injector 7 (not shown). The fuel injector 7 has a corresponding indexing element to set a predetermined angular position between the injector cup 47 and the respective fuel injector 7. Before establishing of the rigid brazed connection between the pipe 41 and the injector cup 47, the injector cup 47 is rotatable relative to the pipe 41 around the central axis R so that the angular position of the indexing element 471 relative to the elongation direction E is variable and adjustable during manufacturing of the fuel rail assembly 3.

Since the fixation bracket 49 is connected to the pipe 41 only during assembling the fuel rail assembly 3 and the connection surface 496 allows for any desired rotational orientation of the central axis C of the receptacle bore 490 with respect to the central axis R of the fixation portion of the pipe 41 as rotational axis, the angular position αB of the tubular receptacle 490 to the elongation direction E of the fuel rail 31 (cf. FIG. 2) is also adjustable during manufacturing the fuel rail assembly 3.

Also the axial position hB of the bracket 49 on the pipe 41 is adjustable before the rigid brazed connection between the pipe 41 and the connection plates 495 is established (cf. FIG. 1). In the present embodiment, the axial position hB is given relative to the axial position—with respect to the central axis R of the pipe 41—of the opening of the recess of the injector cup 47 through which opening the injector is inserted into the recess. Also, the distance dL between the individual fuel delivery lines 11 is adjustable by means of positioning the outlet port tube 39.

In addition, by means of the shape and length of the pipe 41, a lateral offset wL of the injector cup 47—and, thus, the fuel injector 7—from the fuel rail 31 (see FIG. 2) and the distance hL of the fuel rail 31 to the fuel injector cup 47 in the mounting direction M (see FIG. 1) is adjustable. Finally also the length of the fuel rail 31 can be selected.

Apart from changing the shape and length of the pipe 41 and the length of the fuel rail 31, all of the above mentioned adjustments in angles, positions and distances can be achieved using the same standard components. Therefore, the fuel rail assembly 3 is easily configurable in size and shape for different engines 1 with using the same parts. Therefore, a particular cost-effective manufacturing of the fuel rail assembly 3 is achievable.

The fixation bracket 49 of the fuel rail assembly 3 according to the first embodiment is in the general shape of a bar having a rectangular cross-section so that its external surface comprises first and second planar surfaces 491*a*, 491*b* which are perpendicular to the central axis C of the receptacle bore 490. The receptacle bore 490 perforates the first and second planar surfaces 491*a*, 491*b* and extends from the first planar surface 491*a* to the second planar surface 491*b*.

Further, the external surface of the fixation bracket 49 comprises third and fourth planar surfaces 492*a*, 492*b* which are perpendicular to the first and second planar surfaces 491*a*, 491*b* and extend in direction from the receptacle bore 490 to the pipe 41. The third and fourth planar surfaces 492*a*, 492*b* share common interfaces with the first and second planar surfaces 491*a*, 491*b* so that they connect the first planar surface 491*a* to the second planar surface 491*b*.

At its side facing away from the pipe 41, the external surface of fixation bracket 49 comprises a semi-cylindrical surface, interfacing with the first, second, third, and fourth planar surfaces 491*a*, 491*b*, 492*a*, 492*b* and having a cylinder axis which is parallel to the central axis C of the receptacle bore 490. The surface of the fixation bracket 49 at its side adjoining the pipe 41, is represented by the connection surface 496 which is in the shape of a section of a cylinder shell and is in full area contact with the fixation portion of the pipe 41 and by planar portions 497 which follow the connection surface 496 in direction towards the third planar surface 492*a* and towards the fourth planar surface 492*b*, respectively. The planar portion 497 each share an edge with the third and fourth planar surface 492*a*, 492*b*, respectively. In addition, the surface of the fixation bracket 49 at its side adjoining the pipe 41 shares common edges with the first and second planar surfaces 491*a*, 491*b*.

Figure 4:
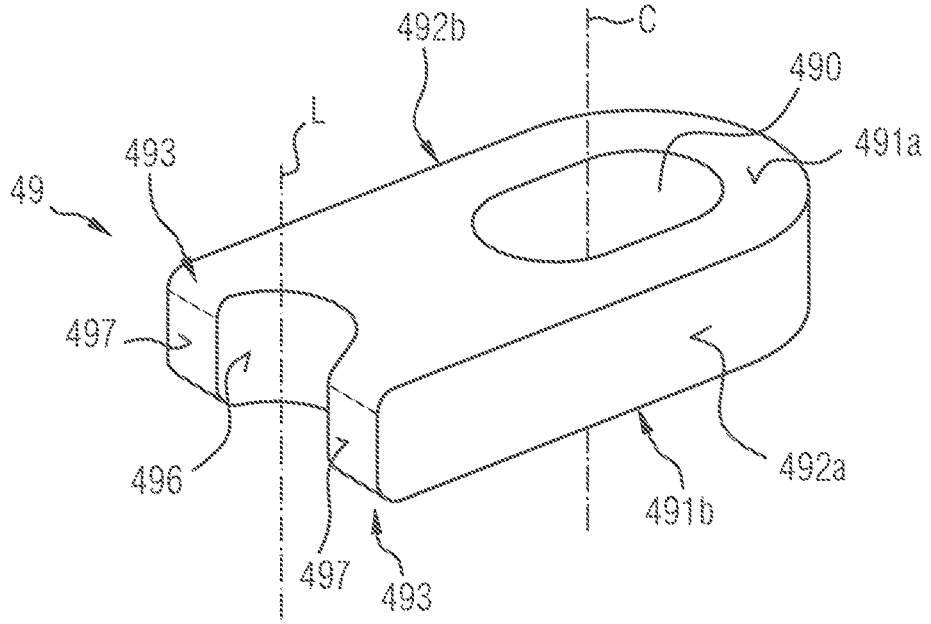
FIG. 4 shows a perspective view of a fixation bracket according to a second embodiment.

FIG. 4 shows a fixation bracket 49 for a fuel rail assembly 3 according to a second exemplary embodiment in a perspective view. The fixation bracket 49 and the fuel rail assembly 3 according to the second embodiment correspond in general to that of first embodiment. However, instead of being angulated with sharp edges, the interfaces 493 between the planar portions 497 of the surface of the fixation bracket 49 at its side adjoining the pipe 41 and the first and second planar surfaces 491*a*, 491*b* are rounded—in particular resulting in a cylindrically shaped transition region.

Figure 5:
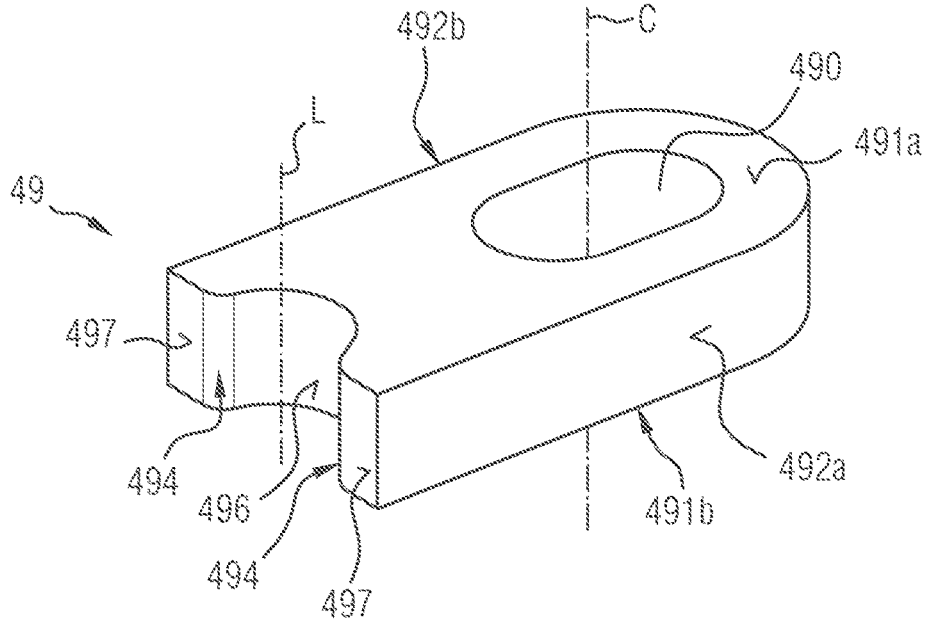
FIG. 5 shows a perspective view of a fixation bracket according to a third embodiment.

FIG. 5 shows a fixation bracket 49 for a fuel rail assembly 3 according to a third exemplary embodiment in a perspective view. The fixation bracket 49 and the fuel rail assembly 3 according to the third embodiment correspond in general to that of first and second embodiments. However, instead of having rounded interfaces 493 with the first and second planar surfaces 491*a*, 491*b*, the surface of the fixation bracket 49 at its side adjoining the pipe 41 has rounded—in particular cylindrically shaped—interfaces 494 between the connection surface 496 and the planar portions 497 which follow the connection surface 496 in direction towards the third planar surface 492*a* and towards the fourth planar surface 492*b*.

Figure 6:
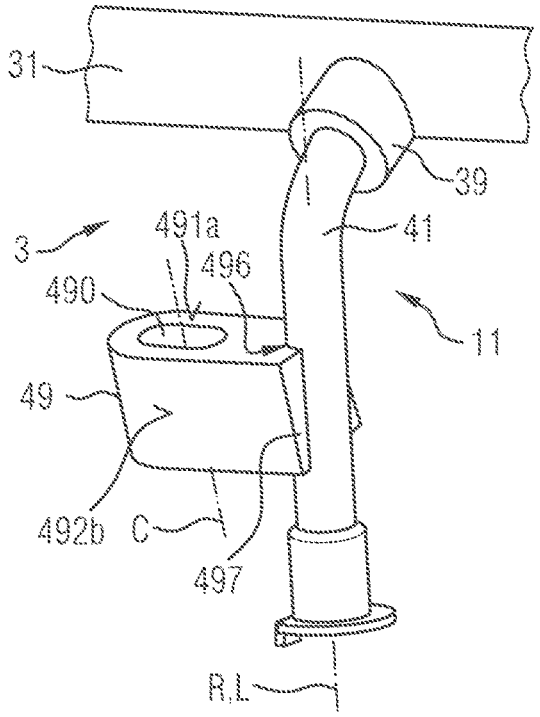
FIG. 6 shows a perspective view of a fuel rail assembly according to a fourth embodiment.

FIG. 6 shows a perspective view of a fuel rail assembly 3 according to a fourth embodiment. The fuel rail assembly 3 according to the fourth embodiment corresponds in general to that of first embodiment. However, the central axis C of the receptacle bore 490 is not parallel to the central axis R of the fixation portion of the pipe 41. Rather, these two axes C, R are inclined with respect to one another.

The inclination is achieved by the cylindrical connection surface 496 having a longitudinal axis L—the cylinder axis of the cylinder shell portion which represents the connection surface 496—which is not parallel to the central axis C of the receptacle bore 490. In particular, the longitudinal axis L is inclined relative to the surface normals of the first and second planar surfaces 491*a*, 491*b*. Thus, contrary to the first embodiment, the planar portions 497 which follow the connection surface 496 in direction towards the third planar surface 492*a* and towards the fourth planar surface 492*b* have no rectangular shape but a trapezoidal shape. The edges of the trapezoidal shape which adjoin the first and second planar surfaces 491*a*, 491*b*, respectively, have different lengths.

Figure 7:
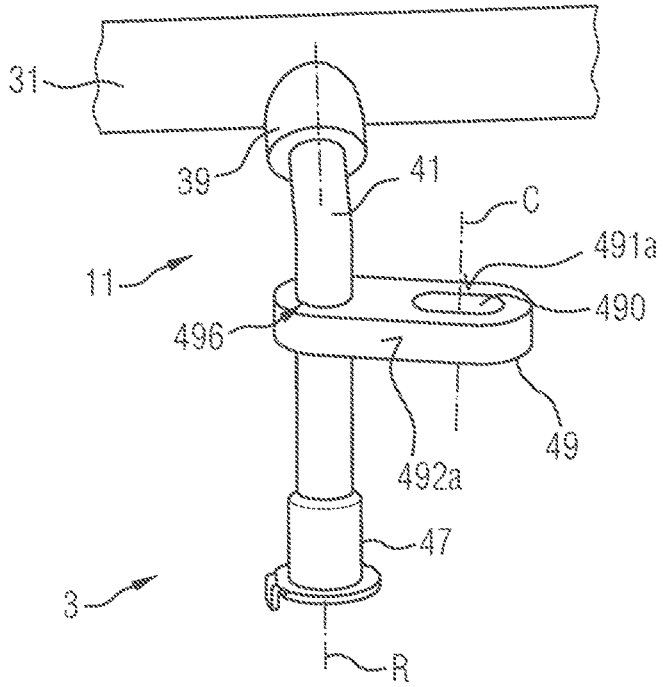
FIG. 7 shows a perspective view of a fuel rail assembly according to a fifth embodiment.

FIG. 7 shows a perspective view of a fuel rail assembly 3 according to a fifth embodiment. The fuel rail assembly 3 corresponds in general to the fuel rail assembly 3 according to first embodiment.

However, the external surface of fixation bracket 49 comprises a semi-cylindrical surface, interfacing with the first, second, third, and fourth planar surfaces 491*a*, 491*b*, 492*a*, 492*b* and having a cylinder axis which is parallel to the central axis C of the receptacle bore 490 not only at its side facing away from the pipe 41 but also at its side adjacent to the pipe 41. In the present embodiment, the connection surface 496 is not a portion of the external, circumferential surface of the fixation bracket. Rather, the connection surface 496 is represented by a through-hole through which the pipe 41 extends. The fixation bracket 49, thus, completely encloses the pipe 41 laterally. A friction-fit connection is established between the connection surface 496 of the fixation bracket 49 and the fixation portion of the pipe 41 which enables adjust and then retain the axial position hB and the rotational position αB of the fixation bracket 49 before and during establishing the rigid brazed connection.

The invention claimed is:

1. A fuel rail assembly for an internal combustion engine, the assembly comprising:

an elongated tubular fuel rail; and a plurality of fuel delivery lines branching off from the fuel rail for hydraulically coupling the fuel rail to fuel injectors operable to inject fuel into the combustion engine;

an injector cup for receiving a fuel inlet portion of a respective one of the fuel injectors;

a pipe arranged between the fuel rail and the injector cup for hydraulically coupling the injector cup to the fuel rail; and a fixation bracket configured for positionally fixing the fuel delivery line with respect to the engine, the fixation bracket comprising a receptacle bore for receiving a fixation element to fix the fixation bracket rigidly to the internal combustion engine;

wherein the injector cup, the pipe, and the fixation bracket are individual parts;

a rigid connection is established between the fixation bracket and a portion of the pipe, said portion spaced apart from each of the fuel rail and from the injector cup; and the fixation bracket is a one-pieced part which adjoins the pipe and is spaced apart from the injector cup and the fuel rail;

wherein the receptacle bore has a non-circular cross-section to allow positioning the pipe at a multiplicity of positions with respect to the internal combustion engine.

2. The fuel rail assembly according to claim 1, further comprising an inlet fitting received in the fuel rail, wherein the inlet fitting is fixed to the fuel rail by a respective brazed or welded connection.

3. A fuel rail assembly according to claim 1, further comprising the rigid connection established between a connection surface of the fixation bracket and said portion of the pipe, the connection surface in the general shape of a section of a cylinder shell to establish a full-area contact between the connection surface and the pipe.

4. The fuel rail assembly according to claim 1, further comprising the rigid connection established between a connection surface of the fixation bracket and said portion of the pipe, the connection surface represented by a through-hole through which the pipe extends.

5. The fuel rail assembly according to claim 1, further comprising an external surface of the fixation bracket having one or more rounded edges adjacent to the pipe.

6. The fuel rail assembly according to claim 5, wherein:

the receptacle bore perforates the fixation bracket in a mounting direction, and a central axis of the opening is inclined with respect to a central axis of said portion of the pipe.

7. The fuel rail assembly according to claim 1, wherein:

the injector cup includes an indexing element for determining an angular position of the respective one of the fuel injectors relative to the injector cup; and the individual parts of the fuel delivery line are configured and connected in such fashion that an angular position of the fixation bracket relative to the indexing element or relative to the elongation direction of the fuel rail is adjustable during assembly of the fuel rail assembly.

8. The fuel rail assembly according to claim 1, wherein the rigid connection is a brazed or welded connection.

9. The fuel rail assembly according to claim 1, wherein the pipe is connected to the injector cup by means of a brazed or welded connection.

10. The fuel rail assembly according to claim 1, wherein each fuel delivery line comprises an outlet port tube attached to an outer surface of the fuel rail by means of a brazed or welded connection.

* * * * *